US007791583B2

(12) United States Patent
Lin et al.

(10) Patent No.: US 7,791,583 B2
(45) Date of Patent: Sep. 7, 2010

(54) FLAT PANEL DISPLAY HAVING OVERDRIVE FUNCTION

(75) Inventors: Hung-Yu Lin, Taichung County (TW); Ying-Hao Hsu, Tainan County (TW); Chi-Ting Huang, Yongkang (TW)

(73) Assignee: Chimei Innolux Corporation, Miao-Li County (TW)

( * ) Notice: Subject to any disclaimer, the term of this patent is extended or adjusted under 35 U.S.C. 154(b) by 903 days.

(21) Appl. No.: 11/520,548

(22) Filed: Sep. 13, 2006

(65) Prior Publication Data

US 2007/0075951 A1 Apr. 5, 2007

(30) Foreign Application Priority Data

Sep. 22, 2005 (TW) ..... 94132909 A

(51) Int. Cl.
*G09G 3/36* (2006.01)

(52) U.S. Cl. ..... 345/101; 345/89

(58) Field of Classification Search ..... 345/89, 345/98, 690, 101

See application file for complete search history.

(56) References Cited

U.S. PATENT DOCUMENTS

| | | | | |
|---|---|---|---|---|
| 6,870,530 | B2 | 3/2005 | Bu et al. | |
| 6,894,669 | B2 | 5/2005 | Suzuki et al. | |
| 7,248,242 | B2 | 7/2007 | Chen et al. | |
| 7,277,076 | B2 | 10/2007 | Shiomi et al. | |
| 7,642,999 | B2 * | 1/2010 | Oura | 345/98 |
| 2001/0024199 | A1 * | 9/2001 | Hughes et al. | 345/204 |
| 2002/0033789 | A1 * | 3/2002 | Miyata et al. | 345/89 |
| 2002/0167471 | A1 * | 11/2002 | Everitt | 345/76 |
| 2003/0107546 | A1 * | 6/2003 | Ham | 345/101 |
| 2003/0179175 | A1 * | 9/2003 | Shigeta et al. | 345/101 |
| 2003/0231158 | A1 * | 12/2003 | Someya et al. | 345/101 |
| 2004/0135800 | A1 * | 7/2004 | Shiomi et al. | 345/691 |
| 2004/0196233 | A1 * | 10/2004 | Shimizu | 345/89 |
| 2005/0068343 | A1 | 3/2005 | Pan et al. | |
| 2005/0073630 | A1 * | 4/2005 | Chen et al. | 349/87 |
| 2006/0103682 | A1 * | 5/2006 | Kunimori et al. | 345/690 |
| 2006/0219700 | A1 * | 10/2006 | Chen et al. | 219/497 |
| 2007/0222707 | A1 * | 9/2007 | Thebault et al. | 345/60 |
| 2007/0223067 | A1 * | 9/2007 | Lee et al. | 358/520 |

FOREIGN PATENT DOCUMENTS

| | | |
|---|---|---|
| TW | I230369 | 4/2005 |
| TW | I232425 | 4/2005 |

OTHER PUBLICATIONS

Taiwan Office Action for Taiwan counterpart application dated Dec. 19, 2008.

* cited by examiner

*Primary Examiner*—Chanh Nguyen
*Assistant Examiner*—Robert M Stone
(74) *Attorney, Agent, or Firm*—Fish & Richardson P.C.

(57) ABSTRACT

A method of operating a display includes deriving first pixel data for overdriving pixel circuits of the display from initial gray levels to target gray levels based on values in the first and second lookup tables, rendering the second lookup table unavailable in memory in response to a change in a temperature of the display, and deriving second pixel data using the first lookup table for overdriving the pixel circuits when the second lookup table is unavailable in the memory.

21 Claims, 13 Drawing Sheets

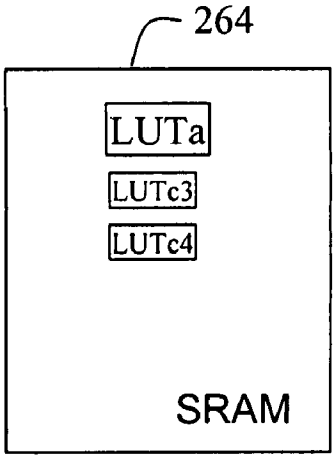
Fig. 7B
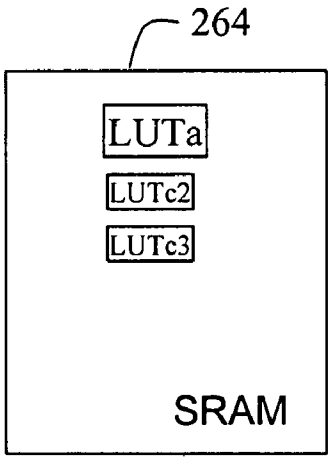
Fig. 7C
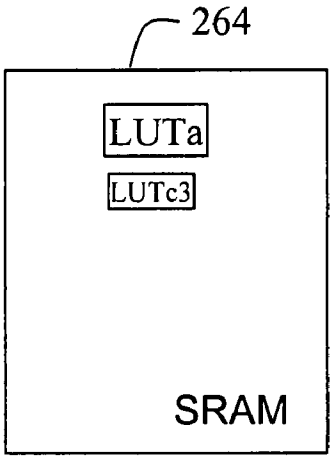
Fig. 7D
Fig. 7E

FLAT PANEL DISPLAY HAVING OVERDRIVE FUNCTION

CROSS-REFERENCE TO RELATED APPLICATIONS

This application claims priority to Taiwan application Serial No. 94132909, filed Sep. 22, 2005, the contents of which are incorporated by reference.

BACKGROUND OF THE INVENTION

The description relates to flat panel displays having overdrive functions.

An example of a flat panel display is a liquid crystal display including an array of pixels, each pixel having a liquid crystal layer that modulates the amount of light that passes the pixel. The brightness of a pixel can be controlled by applying a voltage having a particular value across the liquid crystal layer of the pixel to cause liquid crystal molecules in the layer to have particular orientations. To change a pixel from an initial gray level to a target gray level, the voltage applied to the pixel changes from a first value to a second value, causing the liquid crystal molecules to change from a first orientation to a second orientation. To reduce the amount of time required for changing the orientations of the liquid crystal molecules, an "overdrive" voltage can be applied to cause the liquid crystal molecules to move faster.

Because the viscosity of liquid crystals decreases as temperature increases, the response rate of a pixel (which depends on how fast the liquid crystal molecules can be re-oriented) increases as temperature increases. In some examples, the overdrive voltage is configured to be dependent on the temperature, such that less overdrive is used when the temperature is higher.

Referring to FIG. 1A, an example of a liquid crystal display 10 includes a non-volatile storage (e.g., a flash memory or an electrically erasable programmable read only memory (EEPROM)) 110, a thermal sensor 120, a timing controller 130, and a liquid crystal panel 140. The thermal sensor 120 senses the temperature of the liquid crystal panel 140. The non-volatile storage 110 stores lookup tables LUTa1~LUTam, each storing an array of overdrive gray levels.

Each overdrive gray level represents a gray level that is sent to a data driver for over-driving a pixel from an initial gray level to a target gray level (the initial gray level may be the gray level of a pixel of a previous frame, and the target gray level may be the gray level of the pixel in the current frame). If the target gray level is higher (or lower) than the initial gray level, the overdrive gray level can be slightly higher (or lower) than the target gray level, so that the target gray level is reached faster.

Different lookup tables can be used for different temperatures. For example, the lookup table LUTa1 includes gray levels for overdriving the pixels during a temperature range T1 to T2. The lookup table LUTa2 includes gray levels for overdriving the pixels during a temperature range T2 to T3. When the display 10 is powered on, the timing controller 130 transfers the lookup table LUTa1 from the non-volatile storage 110 to a static random access memory (SRAM) that has a speed faster than the non-volatile storage 110, and uses the values in the lookup table LUTa1 for determining overdrive gray levels used to overdrive the pixels of the liquid crystal panel 140.

Referring to FIG. 1B, when the thermal sensor 120 determines that the temperature has risen to above T2, the timing controller 130 removes the lookup table LUTa1 from the SRAM. Referring to FIG. 1C, the timing controller 130 transfers the lookup table LUTa2 from the non-volatile storage 110 to the SRAM, then determines the overdrive gray levels based on the lookup table LUTa2. During a time period when the lookup table LUTa1 is being removed from the SRAM and the lookup table LUTa2 is being loaded into the SRAM, the timing controller 130 does not perform the overdrive function. For example, the amount of time required to remove and reload a lookup table having 40×40=1600 gray level values, each gray level value having 6 bits, is about 300 to 400 ms.

In some examples, the overdrive voltage is applied to the pixel circuit for a frame period (the time duration for displaying a frame). In some examples, a frame period is divided into two sub-frame periods. In the first sub-frame period, the overdrive voltage is applied to cause the liquid crystal molecules to quickly change to or near a desired orientation. In the second sub-frame period, a "normal" voltage is applied to maintain the liquid crystal molecules at the desired orientation, so that the pixel produces a desired gray level. Examples of overdrive techniques are described in U.S. Pat. No. 6,870,530, the contents of which are incorporated by reference.

SUMMARY

In one aspect, in general, a method of operating a display includes deriving first pixel data for overdriving pixel circuits of the display relative to target gray levels based on values in a first lookup table and a second lookup table, removing the second lookup table in response to a change in an operating condition of the display, and deriving second pixel data using the first lookup table for overdriving the pixel circuits when the second lookup table is unavailable in the memory.

Implementations of the method may include one or more of the following features. Each of the values in the lookup tables is associated with an initial gray level and a target gray level. The operating condition includes a temperature of the display. Deriving first pixel data includes combining at least one of (a) a first value in the first lookup table and a second value in the second lookup table, (b) a first value in the first lookup table and an interpolated value based on a second value in the second lookup table, and (c) a first interpolated value based on a first value in the first lookup table and a second interpolated value based on a second value in the second lookup table. Deriving first pixel data includes calculating an overdrive gray level using values in the first and second lookup tables and a coefficient that is a function of a temperature of the display or a function of a signal representative of the temperature.

In some examples, the method includes loading a third lookup table after the second lookup table is removed from the memory, and deriving third pixel data using the first lookup table and the third lookup table for overdriving the pixel circuits. In some examples, the method includes loading a third lookup table and deriving the first pixel data using the first, second, and third lookup tables. In some examples, deriving second pixel data includes deriving the second pixel data using values in the first and third lookup tables. In some examples, deriving first pixel data includes calculating an overdrive gray level using values in the first, second, and third lookup tables and two coefficients that are functions of a temperature of the display or functions of a signal representative of the temperature. The method includes applying voltages across a liquid crystal layer of the display, the voltages being based on the first pixel data and the second pixel data.

In another aspect, in general, a method includes deriving gray levels for overdriving pixel circuits of a display from initial gray levels to target gray levels based on values in at least two lookup tables that are stored in a memory of the display, different combinations of at least two lookup tables being used to derive the gray levels for different ranges of the temperature of the display.

Implementations of the method may include one or more of the following features. Deriving the gray levels includes deriving each gray level based on a combination of a first value selected from a first one of the at least two lookup tables and a second value selected from a second one of the at least two lookup tables.

In another aspect, in general, a method includes selectively loading and removing values into a memory of a display based on a temperature of the display, each value being useful for deriving a gray level for overdriving a pixel of the display from an initial gray level to a target gray level, and continuously deriving gray levels for overdriving pixels of the display by using the values currently in the memory while other values are being removed from the memory or loaded into the memory.

Implementations of the method may include one or more of the following features. Deriving the gray levels includes deriving each gray level based on a combination of two or more of the values in the memory.

In another aspect, in general, a display includes pixel circuits, a non-volatile storage for storing lookup tables having values useful for deriving overdrive gray levels for overdriving the pixel circuits, a memory, and a controller for transferring at least two of the lookup tables from the non-volatile storage to the memory and using the lookup tables in the memory to derive overdrive gray levels. The controller uses different combinations of two or more lookup tables when a temperature of the display is within different ranges. The controller derives overdrive gray levels using at least one lookup table in the memory while removing another lookup table from the memory or loading another lookup table into the memory.

Implementations of the display may include one or more of the following features. In some examples, the controller uses a first lookup table and a second lookup table to derive the overdrive gray levels when the temperature of the display is within a first range, and uses the first lookup table and a third lookup table to derive the overdrive gray levels when the temperature of the display is within a second range. The first lookup table includes base values of overdrive gray levels, the base values representing coarse estimates of the overdrive gray levels, the second lookup tables includes offset values representing refinements to the coarse estimates for a first temperature range, the third lookup tables includes offset values representing refinements to the coarse estimates for a second temperature range.

The controller derives the overdrive pixel data by using a first value in the first lookup table, a second value in the second lookup table, and a coefficient that is a function of the temperature of the display. The function includes at least one of a linear function and a polynomial function of the temperature. The first lookup table has values associated with a first number (N1) of initial gray levels and a second number (N2) of target gray levels, the second lookup table having values associated with a third number (N3) of initial gray levels and a fourth number (N4) of target gray levels, and N1×N2 is not equal to N3×N4.

The display includes thermal sensors for sensing temperatures at different locations of the display. In some examples, the controller uses a first lookup table, a second lookup table, and a third lookup table to determine the overdrive gray levels when the temperature of the display panel is within a first range, and uses the first lookup table, the third lookup table, and a fourth lookup table to determine the overdrive gray levels when the temperature of the display panel is within a second range. The controller derived the overdrive gray level based on A+f1(T)×B1+f2(T)×B2 when the temperature is within the first range, A being a value in the first lookup table, B1 being a value in the second lookup table, B2 being a value in the third lookup table, T being the temperature, and f1 and f2 being functions of the temperature. The display includes a liquid crystal display.

In another aspect, in general, an apparatus includes a controller for determining pixel data for overdriving pixels of a display based on values in two or more lookup tables stored in a memory of the display, the lookup tables storing values each associated with an initial gray level and a target gray level, the overdriving of the pixels intended to induce a faster response of the pixels. The controller uses different combinations of two or more lookup tables when the display panel is at different temperatures.

In another aspect, in general, a display includes pixel circuits, a non-volatile storage for storing lookup tables, the lookup tables storing values each associated with an initial gray level and a target gray level, a memory having a speed faster than the non-volatile storage, at least one thermal sensor for sensing a temperature of the display, and a timing controller for deriving overdrive pixel data for overdriving the pixel circuits using values in a combination of two or more of the lookup tables stored in the memory. Different combinations of lookup tables are used when the temperature is within different ranges, and the timing controller continuously derives overdrive pixel data using at least one lookup table in the memory while another lookup table is being removed from the memory or loaded into the memory. The display includes data drivers for driving the pixel circuits based on the overdrive pixel data from the timing controller.

Advantages of the method and display include the following. The display has a better image quality because the overdrive function is performed continuously even when lookup tables are being removed from the memory or loaded into the memory in response to temperature changes.

DESCRIPTION OF DRAWINGS

FIGS. 7B to 7E are diagrams of a memory of the display of FIG. 7A.

DESCRIPTION

Flat panel displays (e.g., liquid crystal displays) can use a combination of two or more lookup tables when generating overdrive pixel data for overdriving pixels of the display. Different combinations of lookup tables can be used when the display is at different temperatures. When removing a lookup table and loading another lookup table in response to a change of temperature of the display, one or more of the remaining lookup tables can be used to generate overdrive pixel data.

The term "overdrive pixel data" will refer generally, for example, to overdrive gray levels (e.g., voltage or current values) that are sent to data drivers for overdriving pixels of the display to improve response time. The phrase "overdriving a pixel" does not necessarily mean that the pixel is actually driven beyond a target gray level, but may mean that a gray level different from the target gray level is used to drive the pixel so that the target gray level (or a level near the target gray level) can be reached faster.

Figure 1A:
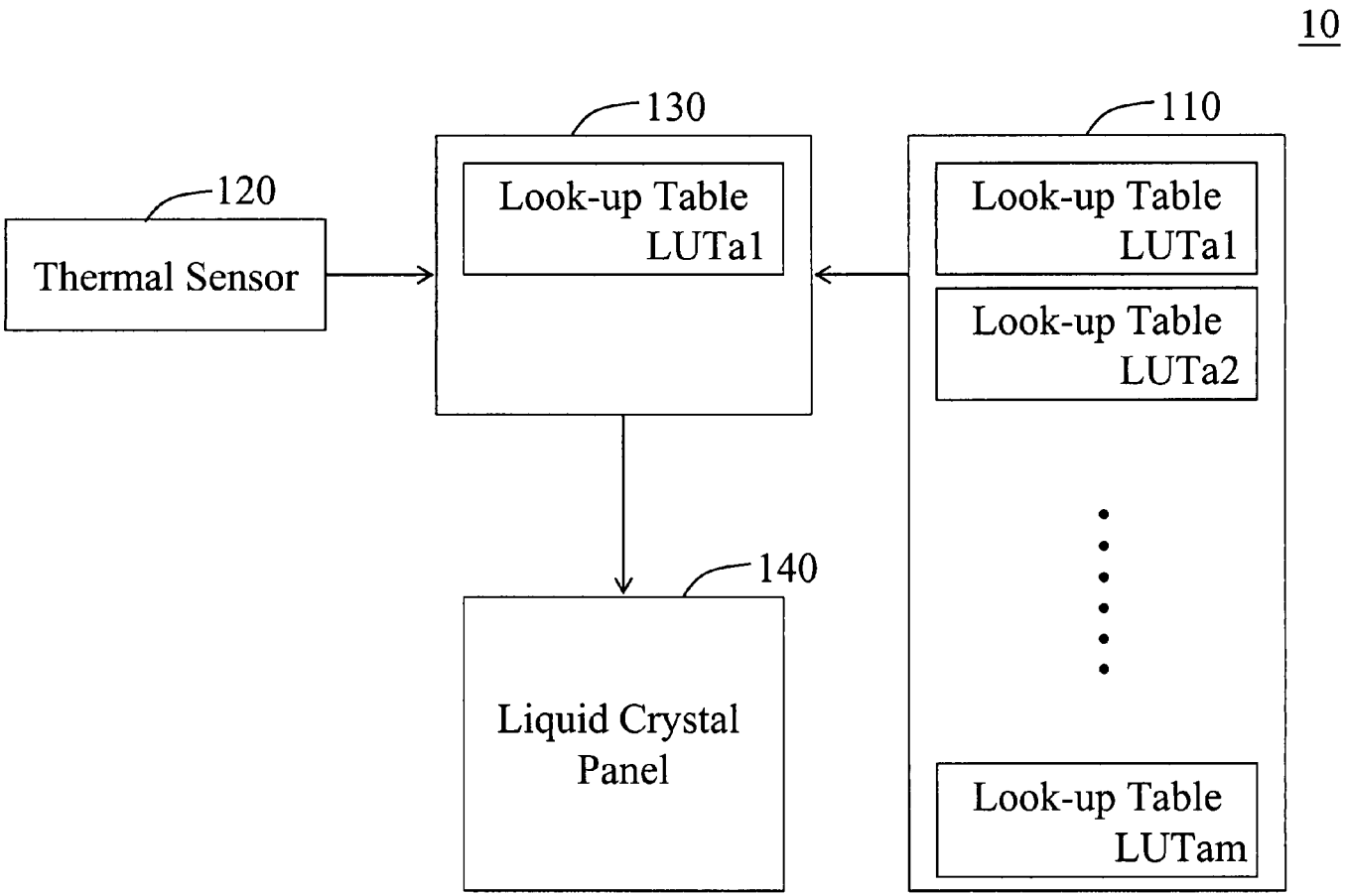
Fig. 1A (Prior Art)
FIGS. 1A to 1C are schematic diagrams of a liquid crystal display.
Figure 1B:
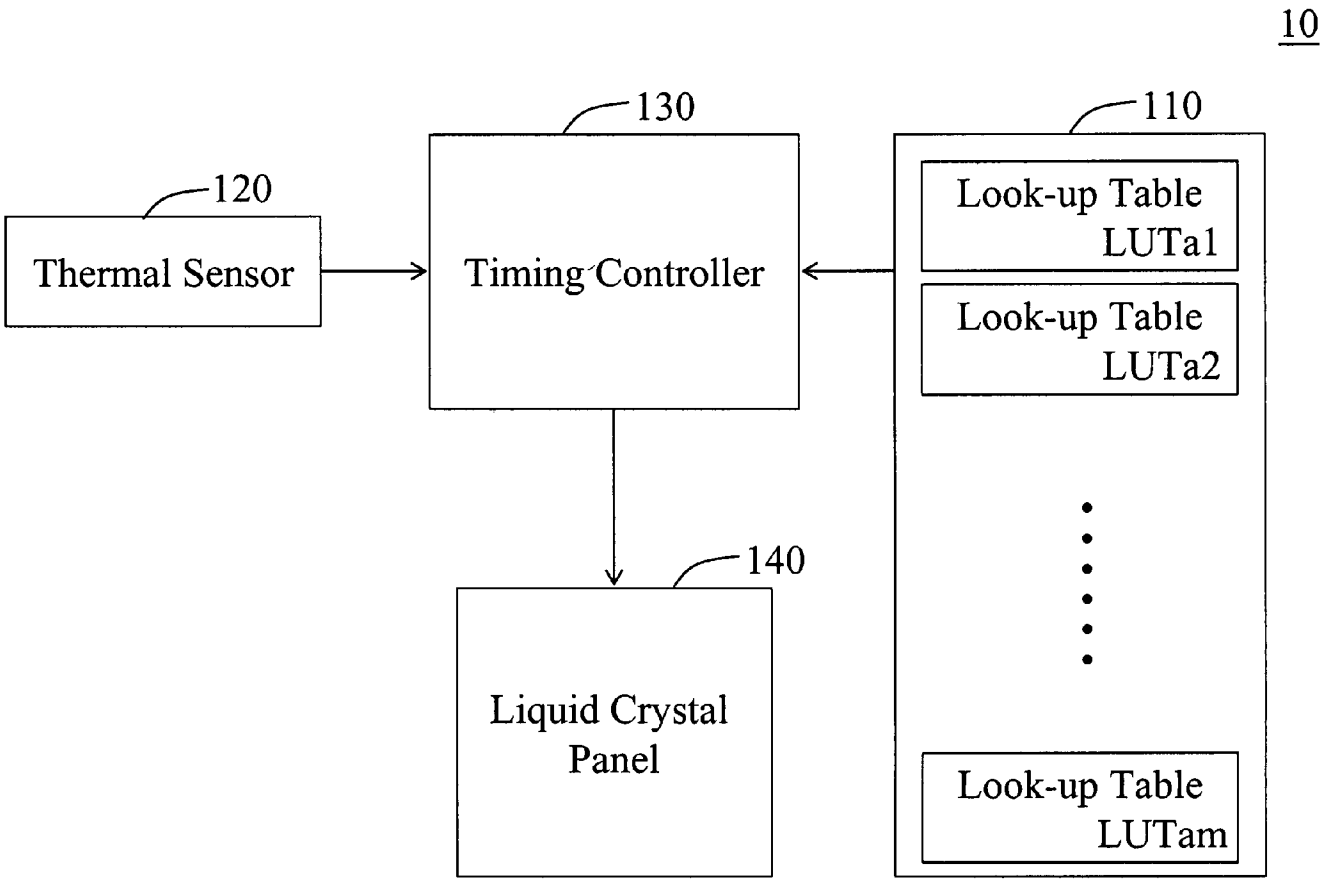
Fig. 1B (Prior Art)
Figure 1C:
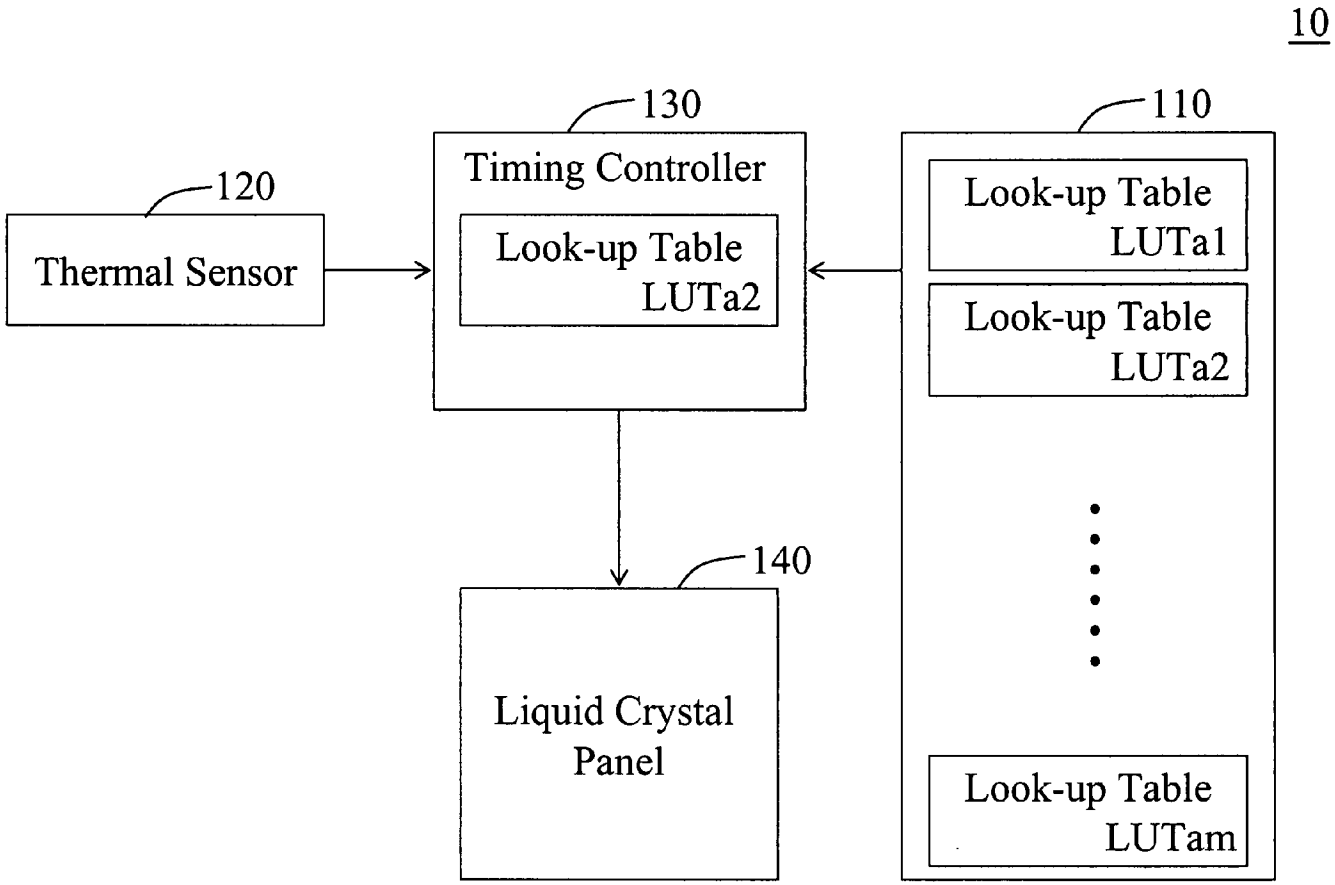
Fig. 1C (Prior Art)
Figure 2:
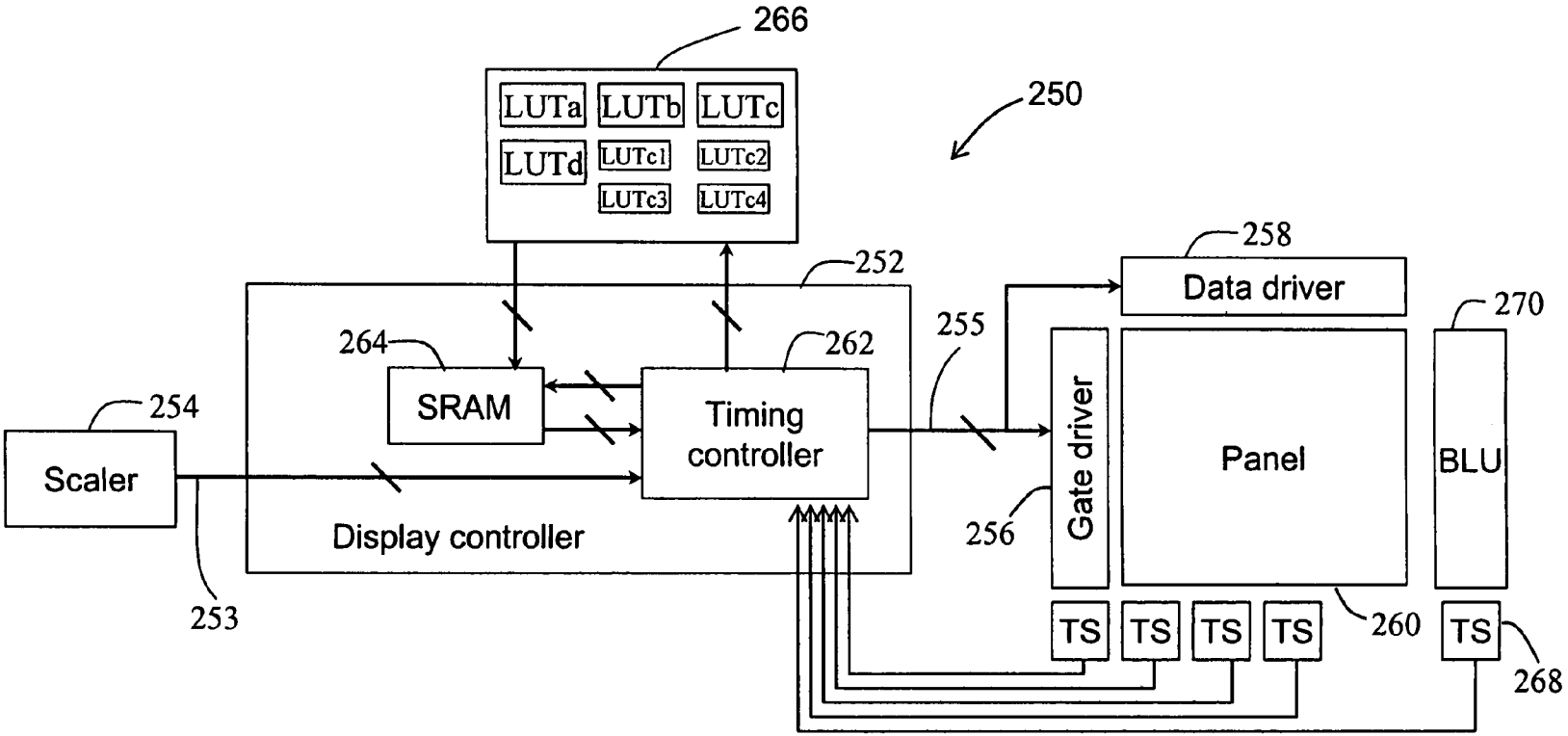
FIG. 2 is a schematic diagram of a liquid crystal display.

Referring to FIG. 2, a liquid crystal display 250 includes a display panel 260 having a array of pixel circuits for showing pixels of images, and a display controller 252 for processing pixel data used to drive the pixel circuits. The display controller 252 receives clock signals, pixel data, and control signals 253 from a scaler 254, which performs scaling functions so that images from a host device (not shown) can be scaled to a proper size and resolution suitable to be shown on the display panel 260. The display controller 252 sends pixel data, clock signals, and control signals 255 to a gate driver 256 and a data driver 258, which in turn drive the pixel circuits.

The display controller 252 includes a timing controller 262 for processing the pixel data from the scaler 254 and, among other functions, generating overdrive pixel data for overdriving the pixel circuits. The display 250 includes a non-volatile storage (such as EEPROM) 266 that stores lookup tables, e.g., main lookup tables LUTa, LUTb, LUTc, and LUTd, and sub-lookup tables, e.g., LUTc1, LUTc2, LUTc3, and LUTc4. Each table has values useful for deriving overdrive pixel data for driving pixels from initial gray levels to target gray levels.

In this example, the main lookup tables provide overdrive gray level base values, and the sub-lookup tables provide overdrive gray level offset values. Different main lookup tables are used for different display refresh rates. For example, the main lookup tables LUTa to LUTd may be used when the display 250 is operating at a refresh rate of 60 Hz, 70 Hz, 80 Hz, and 85 Hz, respectively.

For a given refresh rate, different sub-lookup tables can be used for different temperature ranges. The base values provide coarse estimates of the overdrive gray levels, and the offset values provide refinements to the coarse estimates at different temperature ranges. For example, sixteen sub-lookup tables can be stored in the non-volatile memory 266 (only four of them are shown in the figure), each sub-lookup table being used for a particular range of 3 degrees Celsius. The first sub-lookup table may be used when the temperature of the display is between 0° C. and 3° C., the second sub-lookup table may be used when the temperature of the display is between 3° C. and 6° C., and the sixteenth sub-lookup table may be used when the temperature of the display is between 45° C. and 48° C., and so forth.

The display 250 includes an SRAM 264 for storing the lookup tables used by the timing controller 262 when deriving the overdrive pixel data. The timing controller 262 loads at least two lookup tables into the SRAM 264, and uses the at least two lookup tables (which are stored at the same time in SRAM 264) to determine the overdrive pixel data. The timing controller 262 determines which lookup tables to load into the SRAM 264 based on signals from thermal sensors 268 that sense the temperature of the display 250.

A backlight unit 270 provides light to the panel 260. The light from the backlight unit 270 is modulated by the pixel circuits of the panel 260 to form an image.

The display controller 252 receives a sequence of frames of pixel data from the scaler 254. The SRAM 264 stores the gray level of each pixel of a previous frame Fn-1. When the timing controller 262 receives the gray level g2 of a pixel of a current frame Fn, the timing controller 262 finds the corresponding gray level g1 of the pixel in the previous frame Fn-1 and determines an overdrive gray level OD from the lookup tables based on the gray levels g1 and g2.

To determine the overdrive gray level OD for overdriving a pixel from an initial gray level g1 (of a previous frame) to a target gray level g2 (of a current frame), the timing controller 262 may add the base value in the main lookup table LUTa to the offset value in the sub-lookup table LUTc1, such as $$OD=A+B,$$

where A is the base value and B is the offset value that correspond to the initial gray level g1 and target gray level g2. Interpolation can be used when a particular initial or target gray level is not available in the lookup tables.

The timing controller 262 may also use a formula based on temperature, such as $$OD=A+f(Vt)\times B,$$

where f(Vt) is a function of a combined thermal sensor signal Vt that is derived from the outputs of the thermal sensors 268. As described in more detail below, the signal Vt can be derived from a weighted average of the voltage signals output from the thermal sensors 268.

Figure 3A:
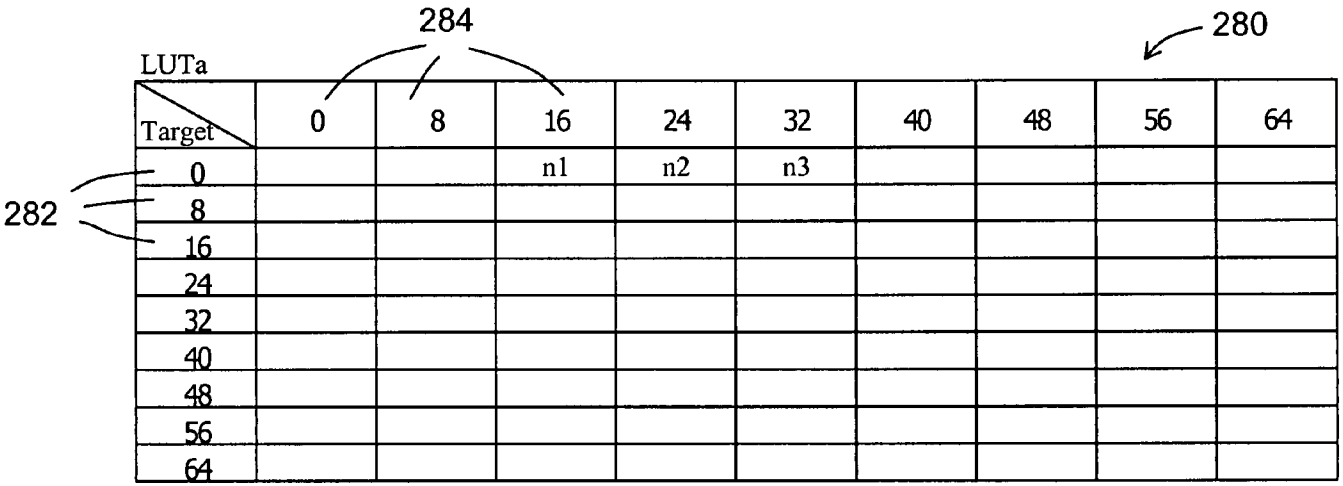
FIGS. 3A and 3B are lookup tables.

To reduce the size of the SRAM 264, the sub-lookup tables can have smaller sizes than the main lookup tables. For example, referring to FIG. 3A, a main lookup table LUTa 280 stores overdrive gray levels for changing from initial gray levels 282, such as 0, 8, 16, 24, 32, 40, 48, 56, and 64, to target gray levels 284, such as 0, 8, 16, 24, 32, 40, 48, 56, and 64. The total number of overdrive gray levels in the main lookup table 280 is 9×9=81.

Figure 3B:
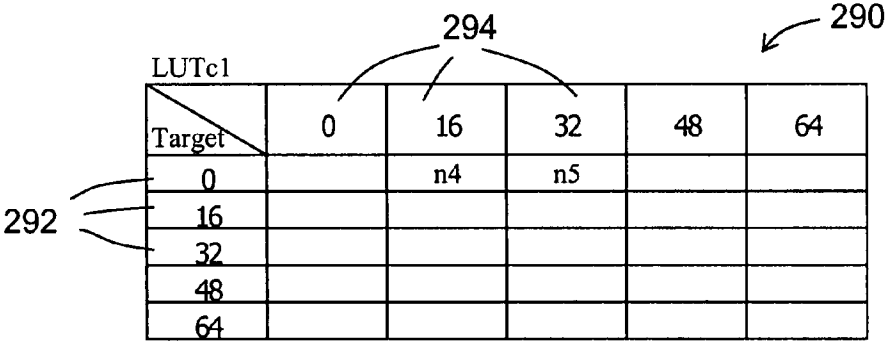

Referring to FIG. 3B, a sub-lookup table LUTc1 290 has overdrive gray levels for changing from initial gray levels 292, such as 0, 16, 32, 48, and 64, to target gray levels 294, such as 0, 16, 32, 48, and 64. The total number of overdrive gray levels in the sub-lookup table is 5×5=25. The blank spaces in the tables are all filled with overdrive gray levels.

Because the size of the main lookup table LUTa 280 and the sub-lookup table LUTc1 290 are different, interpolation may be used to estimate some of the offset values. As an example, assume that in the lookup table LUTa 280, the base values of overdrive gray levels for changing from gray level 0 to gray levels 16, 24, and 32 are n1, n2, and n3, respectively. In the lookup table LUTc1 290, the offset values of overdrive gray levels for changing from gray level 0 to gray levels 16 and 32 are n4 and n5, respectively. If a pixel changes from gray level 0 to gray level 32, the overdrive gray level will be n3+n5, where n3 is the base value in LUTa 280 and n5 is the offset value in LUTc1 290. If a pixel changes from gray level 0 to gray level 24, because the lookup table LUTc1 does not have data for the target gray level 24, interpolation is used to determine what offset value to use.

In some examples, the overdrive gray level can be calculated as $$OD=n2+K\times n4,$$

where K is a coefficient used for interpolation, n2 is the base value from LUTa, and n4 is the offset value from LUTc1. In some examples, the overdrive gray level can be calculated as $$OD=n2+f(Vt)\times K\times n4,$$

where f(Vt) is a function of the combined thermal sensor signal Vt that is derived from the outputs of the thermal sensors 268.

Figure 8A:
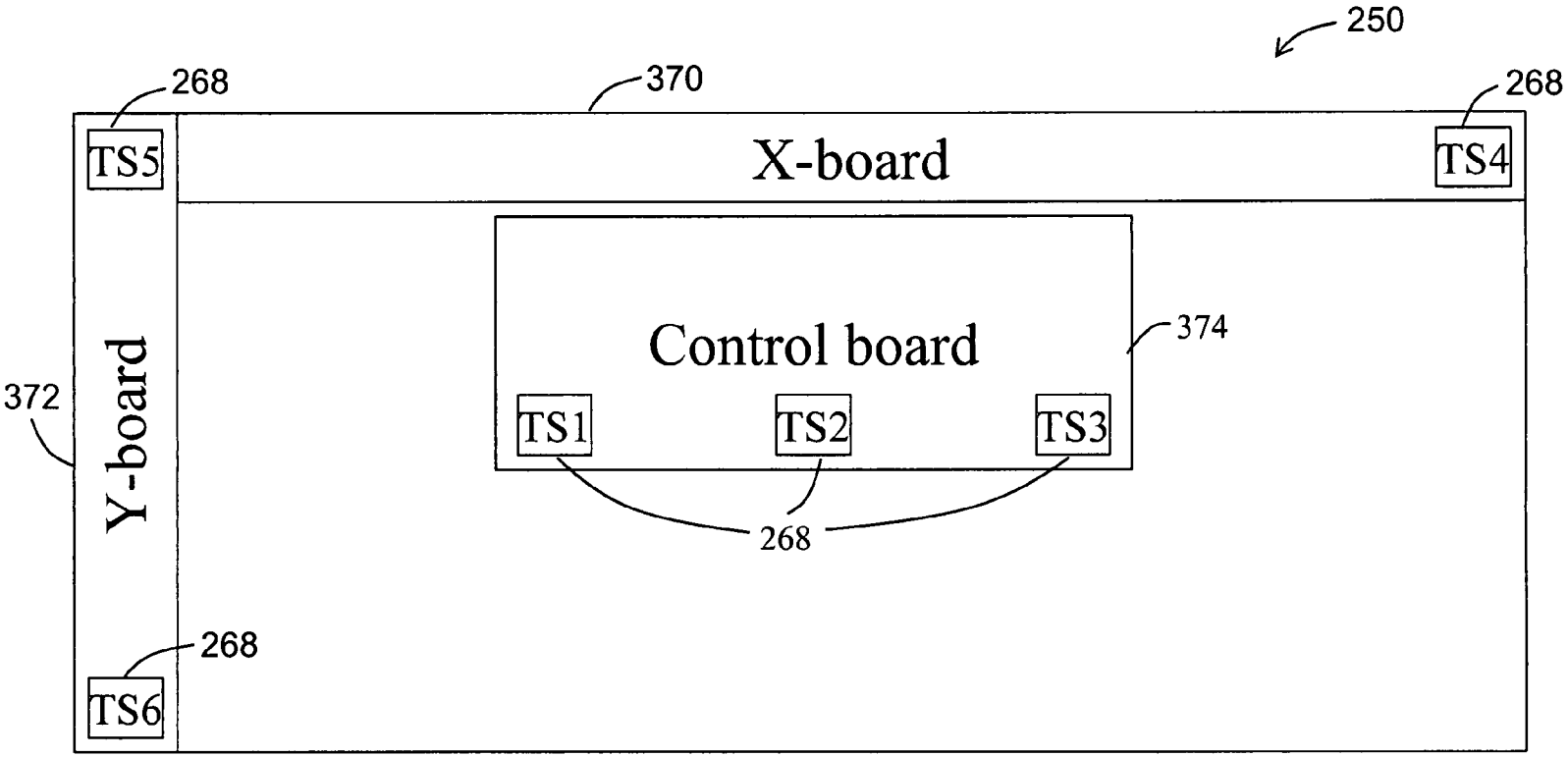
FIGS. 8A and 8B are diagrams of the back side and front side of a display.

The following provides a description of the combined thermal sensor signal Vt. Referring to FIG. 8A, a number of thermal sensors 268, such as TS1 to TS6, can be positioned at various locations at the backside of the liquid crystal display 250. At the backside of the liquid crystal display 250, there are a number of circuit boards, such as an X-board 370 that extends horizontally, a Y-board 372 that extends vertically, and a control board 374. The X-board 370 includes components such as a DC/DC converter, a GAMMA circuit, resistors, capacitors, and signal lines for transmitting power, control signals, and data signals. The Y-board 372 includes components such as resistors, capacitors, and signal lines for transmitting control signals and power to scan drivers. The control board 374 includes the timing controller 262 and signal lines for transmitting power, control signals, and data signals.

A combined back thermal sensor signal V_TS_back can be generated using a weighted average of the voltage signals from the thermal sensors TS1 to TS6:

$$V_TS_\text{back}=(W1\times V_TS1+W2\times V_TS2+W3\times V_TS3+W4\times V_TS4+W5\times V_TS5+W6\times V_TS6)/(W1+W2+W3+W4+W5+W6),$$

where W1 to W6 are weight coefficients, and V_TS1 to V_TS6 are the voltage signals from the thermal sensors TS1 to TS6, respectively. The combined back thermal sensor signal V_TS_back provides an indication of the average temperature of the backside of the display 250.

Figure 8B:
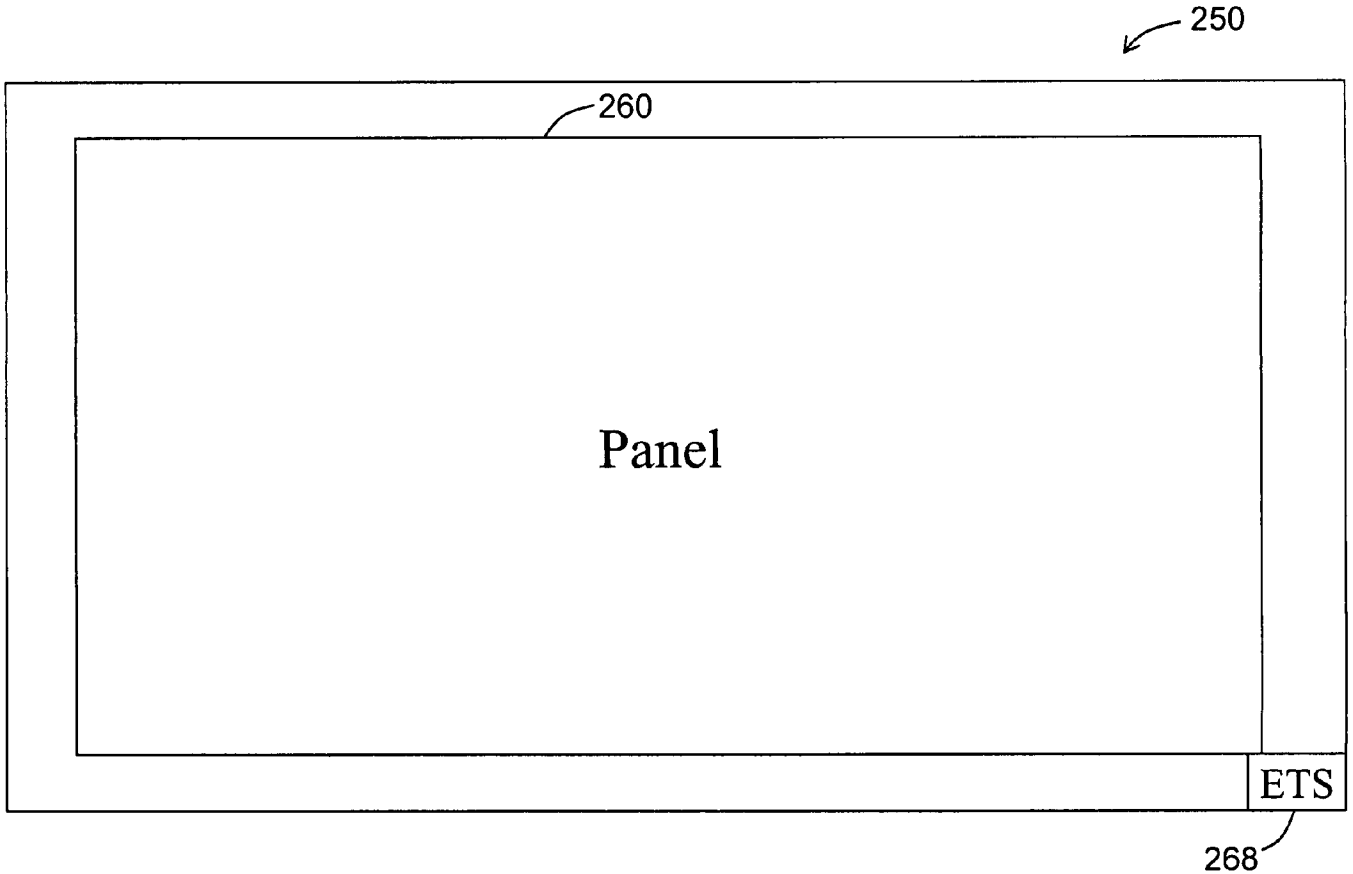

Referring to FIG. 8B, the front side of the liquid crystal display 250 can include a thermal sensor 268 that senses the temperature of the environment and generates an environment thermal sensor signal V_env. A combined thermal sensor signal Vt can be generated using a weighted average of the combined back thermal sensor signal V_TS_back and the environment thermal sensor signal V_env:

$$Vt=a\times V_TS_\text{back}+b\times V_env,$$

where a and b are weight coefficients. The combined thermal sensor signal Vt provides an indication of the overall temperature of the display 250.

The following describes a number of examples of the liquid crystal display 250 in which the timing controller 262 overdrives the display panel 260 based on two or more lookup tables.

EXAMPLE 1

Figure 4:
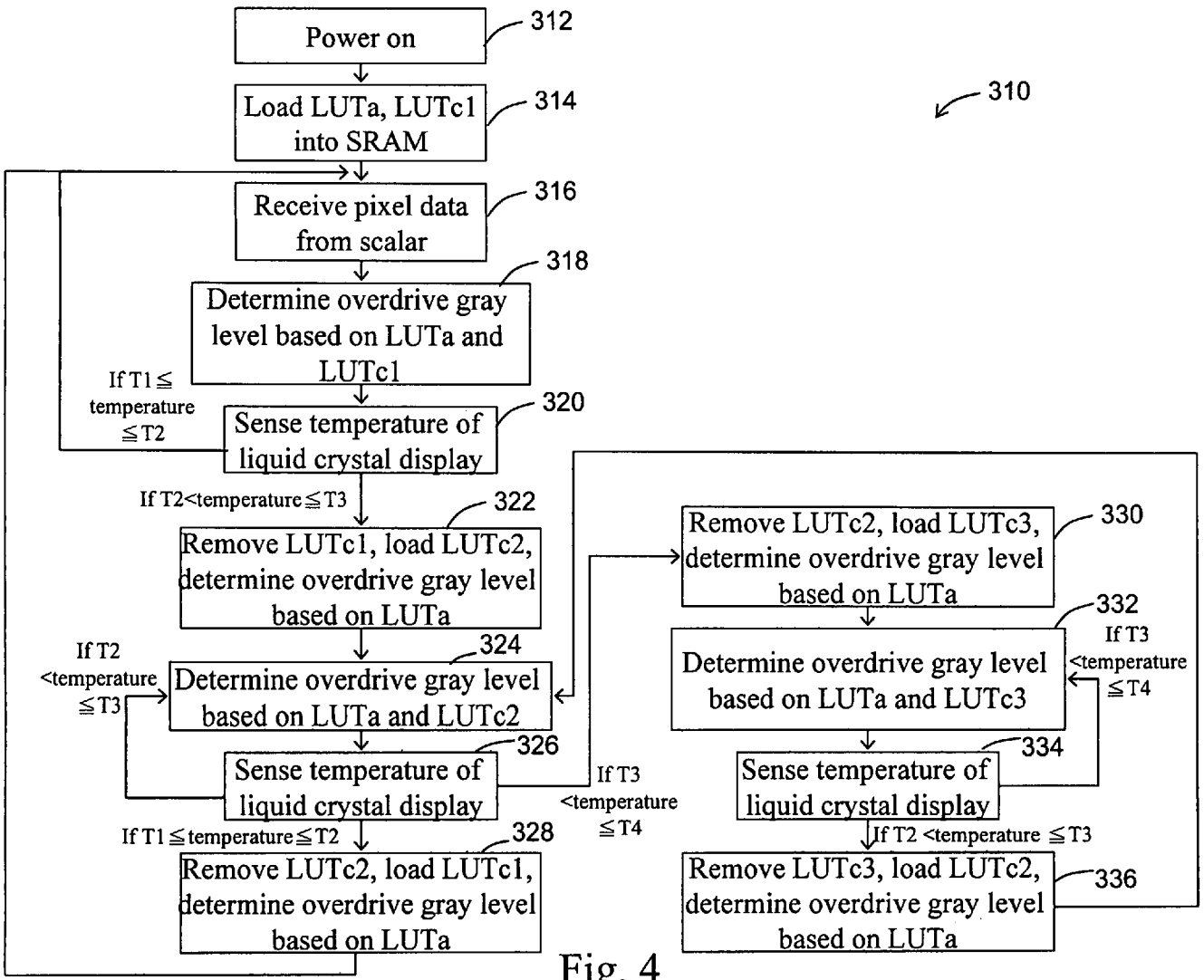
FIG. 4 is a flow diagram.

In example 1, the timing controller 262 uses two lookup tables to determine the overdrive pixel data when the temperature of the display 250 is within a specified range. FIG. 4 is a flow diagram of a process 310 for overdriving the display panel 260 using two lookup tables when the temperature of the display 250 is within specified ranges. FIGS. 5A to 5D show the contents of the SRAM 264 during operation of the display 250.

Figure 5A:
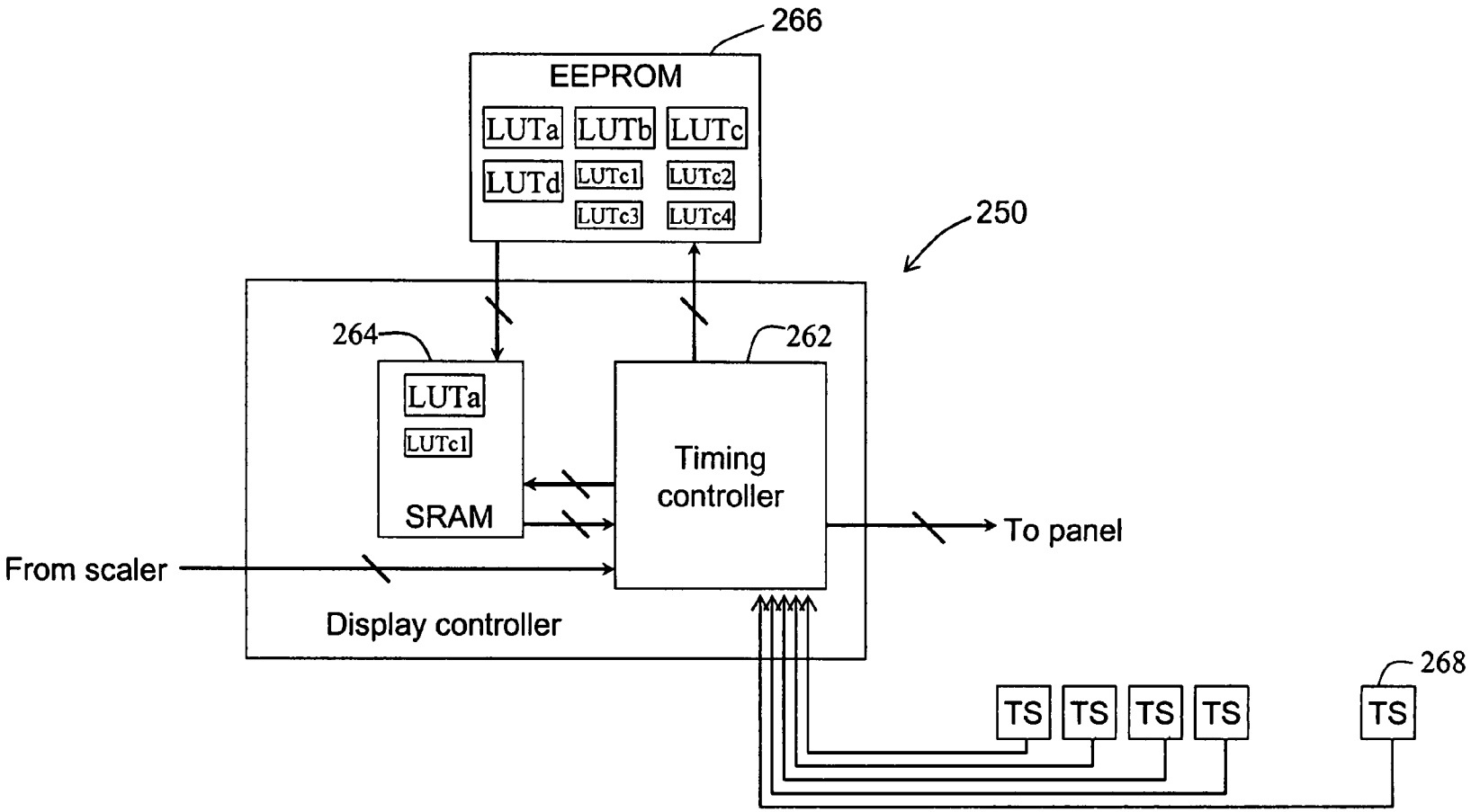
FIG. 5A is a diagram of the display.
Figure 5D:
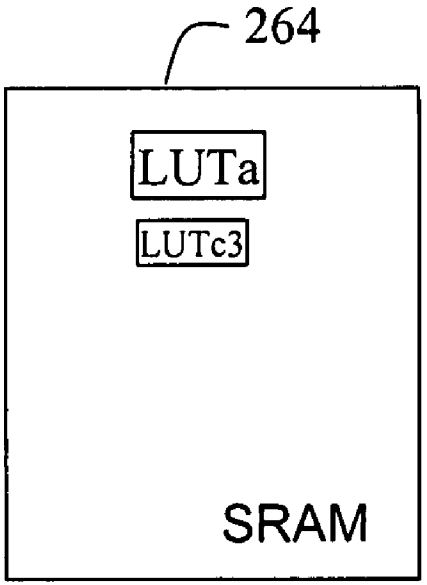
FIGS. 5B to 5D are diagrams of a memory of the display of FIG. 5A.

Referring to FIG. 4, upon power on 312 of the display 250, the timing controller 262 loads 314 the main lookup table LUTa and the sub-lookup table LUTc1 into the SRAM 264 (as shown in FIG. 5A). The timing controller 262 receives 316 pixel data from the scaler 254 and determines 318 overdrive gray levels that are sent to the data driver for overdriving the pixel circuits of the panel 260. The timing controller 262 determines the overdrive gray level for driving each pixel circuit by adding a base value in the main lookup table LUTa to a corresponding offset value in the sub-lookup table LUTc1.

Figure 5C:
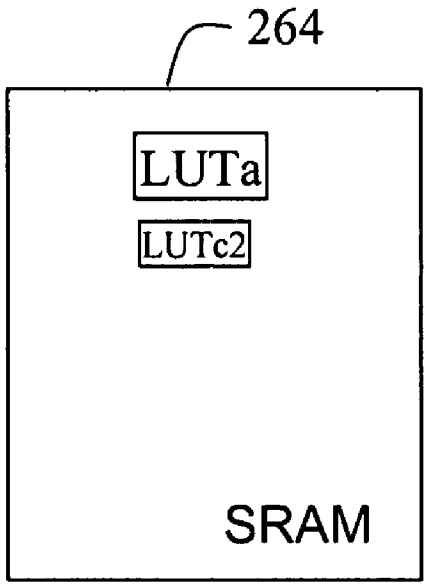

In example 1, the lookup table LUTc1 is used for a temperature range T1 to T2, the lookup table LUTc2 is used for a temperature range T2 to T3, and the lookup table LUTc3 is used for a temperature range T3 to T4. The thermal sensors 268 sense 320 the temperature of the display 250. If the temperature of the display 250 is between T1 and T2, the process 310 loops back to step 316. If the temperature of the display 250 increases to a value between T2 and T3, the timing controller 262 renders the sub-lookup table LUTc1 unavailable in memory, such as removing 322 the sub-lookup table LUTc1 from the memory 264 (as shown in FIG. SB), and transfers the sub-lookup table LUTc2 from the non-volatile memory 266 to the SRAM 264 (as shown in FIG. 5C). During the time period in which LUTc1 is being removed and LUTc2 is being loaded into the SRAM 264, the timing controller 262 uses the main lookup table LUTa to determine the overdrive gray levels. In this way, a temporary interruption in the overdrive function during the short time period for removing and loading the sub-lookup tables to the SRAM 264 can be avoided.

Although the overdrive gray levels that are determined using a main lookup table alone may not be as accurate as those determined using both the main lookup table and a sub-lookup table, driving the panel 260 using the overdrive gray levels derived from the main lookup table alone is still better than just using target gray levels (without overdrive) to drive the panel 260.

In this description, the lookup tables are described as being used when the temperature of the display is within a certain temperature range. Because the temperature of the display 250 is represented by the combined thermal sensor signal Vt, the timing controller 262 determines when to remove or load lookup tables based on the combined thermal sensor signal Vt.

After the sub-lookup table LUTc2 is loaded into the SRAM 264, the timing controller 262 determines 324 the overdrive gray levels for driving the pixel circuits of the display panel 260 based on the main lookup table LUTa and the sub-lookup table LUTc2.

Figure 5B:
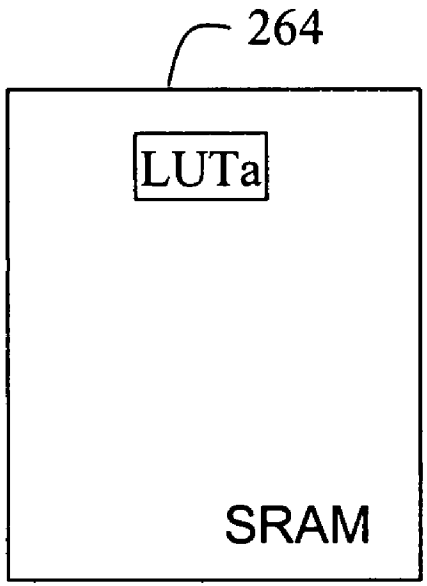

The thermal sensors 268 sense 326 the temperature of the display 250. If the temperature of the display 250 is between T2 and T3, the process 310 loops back to step 324. The timing controller 262 continues to determine the overdrive gray levels based on the lookup tables LUTa and LUTc2. If the temperature of the display 250 decreases to a value between T1 and T2, the timing controller 262 removes 328 the sub-lookup table LUTc2 from the memory 264 (as shown in FIG. 5B), and transfers the sub-lookup table LUTc1 from the non-volatile memory 266 to the SRAM 264 (as shown in FIG. 5A). During the time period in which LUTc2 is being removed and LUTc1 is being loaded into the SRAM 264, the timing controller 262 uses the main lookup table LUTa to determine the overdrive gray levels. The process 310 loops back to step 316.

If the temperature of the display 250 increases to a value between T3 and T4, the timing controller 262 removes 330 the sub-lookup table LUTc2 from the memory 264 and transfers the sub-lookup table LUTc3 from the non-volatile memory 266 to the SRAM 264 (as shown in FIG. SD). During the time period in which LUTc2 is being removed and LUTc3 is being loaded into the SRAM 264, the timing controller 262 uses the main lookup table LUTa to determine the overdrive gray levels. After the sub-lookup table LUTc3 is loaded into the SRAM 264, the timing controller 262 determines 332 the overdrive gray levels for driving the pixel circuits of the display panel 260 based on the main lookup table LUTa and the sub-lookup table LUTc3.

The thermal sensors 268 sense 334 the temperature of the display 250. If the temperature of the display 250 is between T3 and T4, the process 310 loops back to step 332. The timing controller 262 continues to determine the overdrive gray levels based on the lookup tables LUTa and LUTc3. If the temperature of the display 250 decreases to a value between T2 and T3, the timing controller 262 removes 336 the sub-lookup table LUTc3 from the memory 264 (as shown in FIG. 5B), and transfers the sub-lookup table LUTc2 from the non-volatile memory 266 to the SRAM 264 (as shown in FIG. 5C). During the time period in which LUTc3 is being removed and LUTc2 is being loaded into the SRAM 264, the timing controller 262 uses the main lookup table LUTa to determine the overdrive gray levels. After the sub-lookup table LUTc2 is loaded into the SRAM 264, the process 310 loops back to step 324.

When the temperature of the display 250 increases to a value higher than T4, the sub-lookup tables can be removed and loaded into the SRAM 264 using steps similar to those described above.

The temperature sensors 268 may continuously monitor the temperature of the display 250 while the timing controller 262 continuously receives pixel data from the scaler 254 and generates overdrive pixel data to drive the panel 260. The timing controller may poll the output signals from the temperature sensors 268 periodically and switch lookup tables when the temperature changes between specified ranges.

If the user changes the refresh rate of the display 250, the timing controller may remove the main lookup table LUTa from the SRAM 264 and load another main lookup table (e.g., LUTb) based on the new refresh rate.

The overdrive function is useful when a video is shown on the display 250. A video includes a sequence of frames of images that may change rapidly from one frame to another. The overdrive function enables the pixels to respond faster so that the pixels can reach the target gray levels faster, allowing the video to be shown with more accurate colors and less blurring.

EXAMPLE 2

Figure 6:
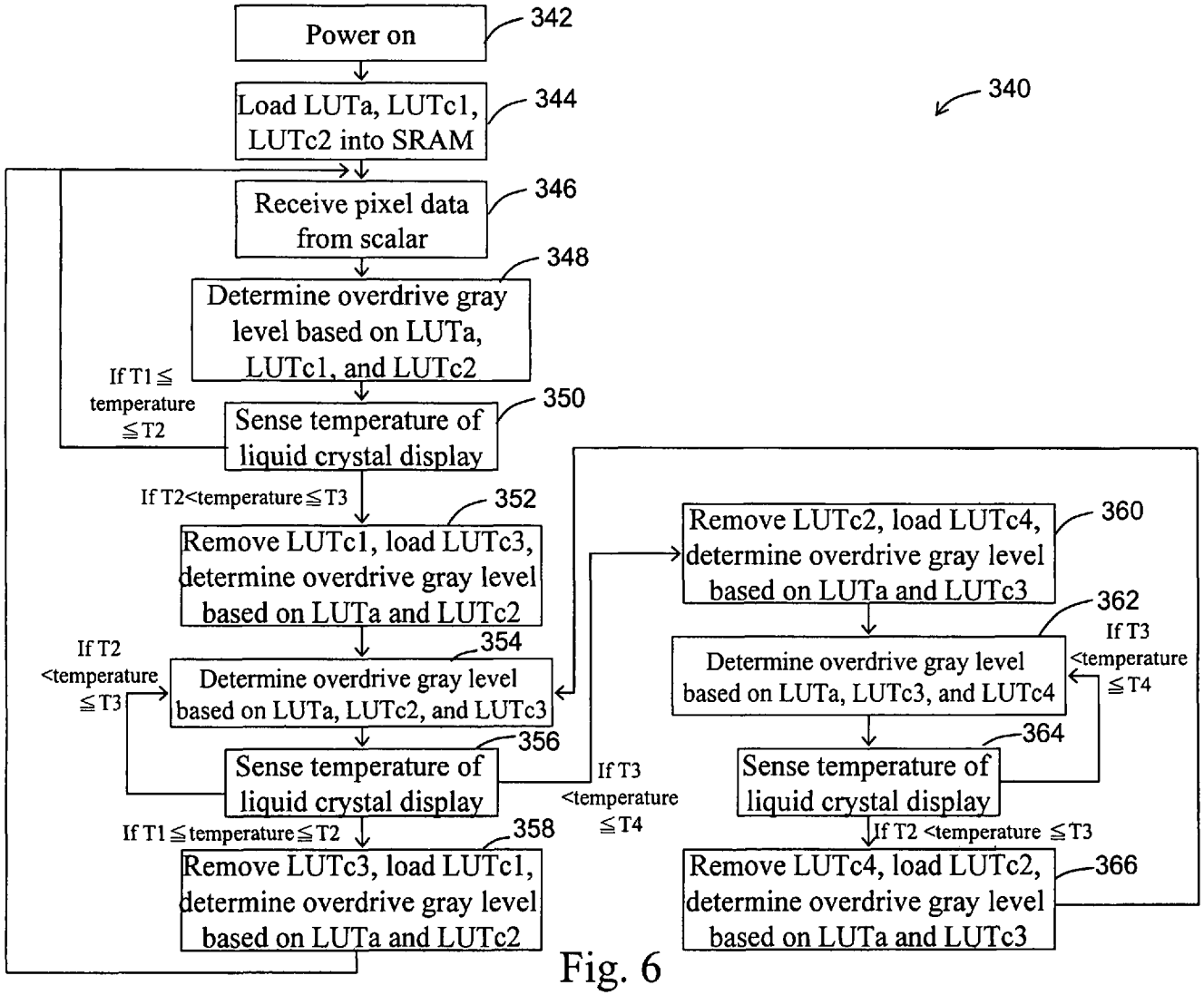
FIG. 6 is a flow diagram.

In example 2, the timing controller 262 uses three lookup tables to determine the overdrive pixel data when the temperature of the display 250 is within a specified range. FIG. 6 is a flow diagram of a process 340 for overdriving the liquid crystal display 250 using three lookup tables when the temperature of the display 250 is within a specified range. FIGS. 7A to 7E show the contents of the SRAM 264 during operation of the display 250.

Figure 7A:
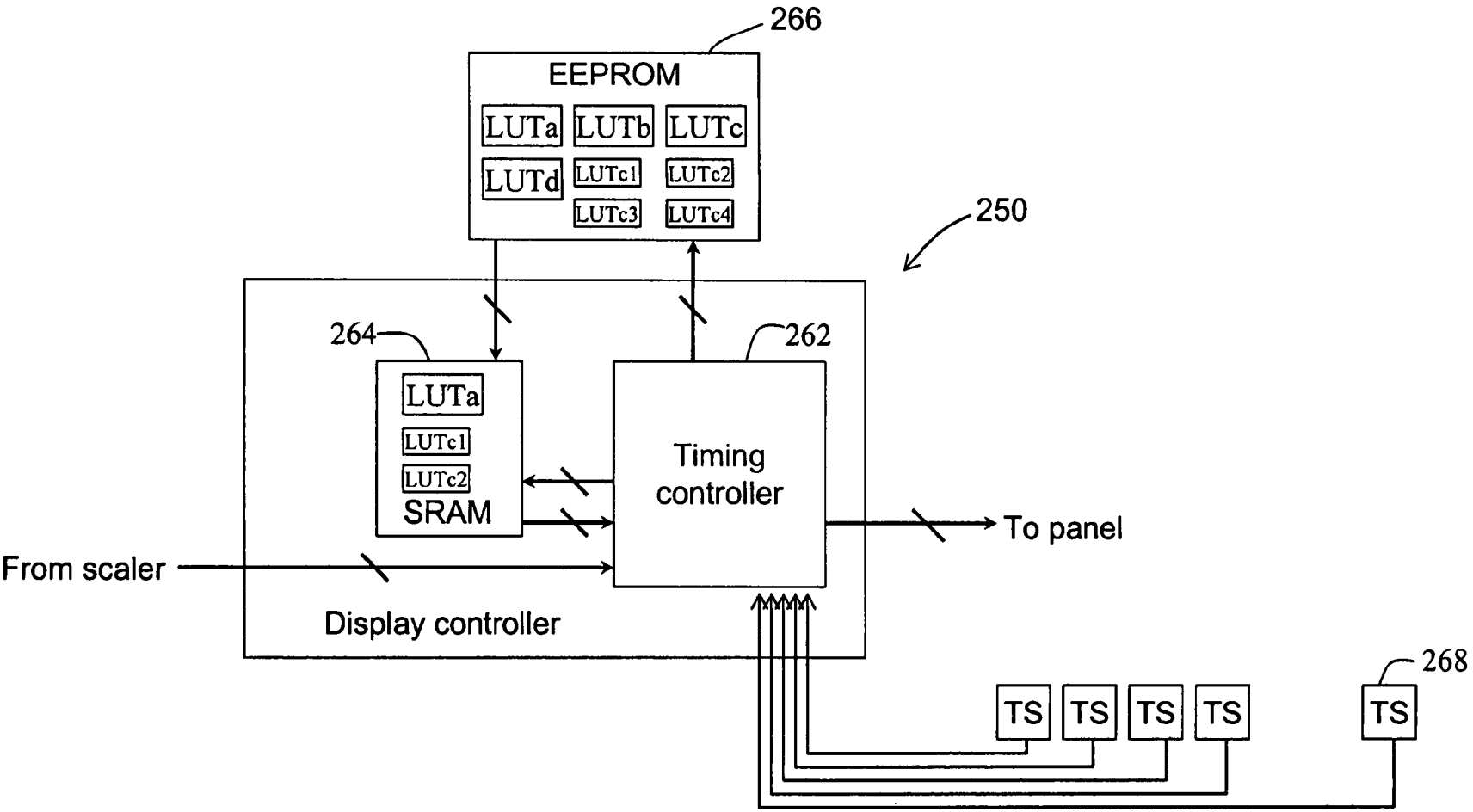
FIG. 7A is a diagram of a display.

Referring to FIG. 6, upon power on 342 of a display 340, the timing controller 262 loads 344 the main lookup table LUTa and the sub-lookup tables LUTc1 and LUTc2 into the SRAM 264 (as shown in FIG. 7A). The timing controller 262 receives 346 pixel data from the scaler 254 and determines 348 overdrive gray levels that are sent to the data driver 258 for overdriving the pixel circuits of the panel 260. The timing controller 262 determines the overdrive gray level for driving each pixel circuit by adding a base value in the main lookup table LUTa to corresponding offset values in the sub-lookup tables LUTc1 and LUTc2.

In this example, the sub-lookup tables LUTc1 and LUTc2 are used for a temperature range T1 to T2, the sub-lookup tables LUTc2 and LUTc3 are used for a temperature range T2 to T3, and the sub-lookup tables LUTc3 and LUTc4 are used for a temperature range T3 to T4.

The thermal sensors 268 sense 350 the temperature of the display 250. If the temperature of the display 250 is between T1 and T2, the process 340 loops back to step 346. If the temperature of the display 250 increases to a value between T2 and T3, the timing controller 262 removes 352 the sub-lookup table LUTc1 from the memory 264 (as shown in FIG. 7B), and transfers the sub-lookup table LUTc3 from the non-volatile memory 266 to the SRAM 264 (as shown in FIG. 7C). During the time period in which LUTc1 is being removed and LUTc3 is being loaded into the SRAM 264, the timing controller 262 uses the main lookup table LUTa and the sub-lookup table LUTc2 to determine the overdrive gray levels. In this way, a temporary interruption in the overdrive function during the short time period for removing and loading the sub-lookup tables to the SRAM 264 can be avoided.

Using a main lookup table and a sub-lookup table (as in FIG. 7B) to derive the overdrive gray levels may result in a better image quality than just using the main lookup table to derive the overdrive gray levels (as in FIG. 5B).

After the sub-lookup table LUTc3 is loaded into the SRAM 264, the timing controller 262 determines 354 the overdrive gray levels for driving the pixel circuits of the display panel 260 based on the main lookup table LUTa and the sub-lookup tables LUTc2 and LUTc3.

The thermal sensors 268 sense 356 the temperature of the display 250. If the temperature of the display 250 is between T2 and T3, the process 310 loops back to step 354. The timing controller 262 continues to determine the overdrive gray levels based on the lookup tables LUTa, LUTc2, and LUTc3. If the temperature of the display 250 decreases to a value between T1 and T2, the timing controller 262 removes 358 the sub-lookup table LUTc3 from the memory 264 (as shown in FIG. 7B), and transfers the sub-lookup table LUTc1 from the non-volatile memory 266 to the SRAM 264 (as shown in FIG. 7A). During the time period in which LUTc3 is being removed and LUTc1 is being loaded into the SRAM 264, the timing controller 262 uses the main lookup table LUTa and the sub-lookup table LUTc2 to determine the overdrive gray levels. The process 310 loops back to step 346.

If the temperature of the display 250 increases to a value between T3 and T4, the timing controller 262 removes 360 the sub-lookup table LUTc2 from the memory 264 (as shown in FIG. 7D) and transfers the sub-lookup table LUTc4 from the non-volatile memory 266 to the SRAM 264 (as shown in FIG. 7E). During the time period in which LUTc2 is being removed and LUTc4 is being loaded into the SRAM 264, the timing controller 262 uses the main lookup table LUTa and the sub-lookup table LUTc3 to determine the overdrive gray levels.

After the sub-lookup table LUTc4 is loaded into the SRAM 264, the timing controller 262 determines 362 the overdrive gray levels for driving the pixel circuits of the display panel 260 based on the main lookup table LUTa and the sub-lookup tables LUTc3 and LUTc4.

The thermal sensors 268 sense 364 the temperature of the display 250. If the temperature of the display 250 is between T3 and T4, the process 310 loops back to step 362. The timing controller 262 continues to determine the overdrive gray levels based on the lookup tables LUTa, LUTc3, and LUTc4. If the temperature of the display 250 decreases to a value between T2 and T3, the timing controller 262 removes 366 the sub-lookup table LUTc4 from the memory 264 (as shown in FIG. 7D), and transfers the sub-lookup table LUTc2 from the non-volatile memory 266 to the SRAM 264 (as shown in FIG. 7C). During the time period in which LUTc4 is being removed and LUTc2 is being loaded into the SRAM 264, the timing controller 262 uses the main lookup table LUTa and the sub-lookup table LUTc3 to determine the overdrive gray levels. After the sub-lookup table LUTc2 is loaded into the SRAM 264, the process 310 loops back to step 354.

When the temperature of the display 250 increases to a value higher than T4, the sub-lookup tables can be removed and loaded into the SRAM 264 using steps similar to those described above.

The temperature sensors 268 may continuously monitor the temperature of the display 250 while the timing controller 262 continuously receive pixel data from the scaler and generate overdrive pixel data to drive the panel 260. The timing controller may poll the output signals from the temperature sensors 268 periodically and switch lookup tables when the temperature changes between specified ranges.

EXAMPLE 3

In example 3, the timing controller 262 loads a main lookup table LUTa and three sub-lookup tables LUTc1, LUTc2, and LUTc3 into the SRAM 264 upon power on. The timing controller 262 uses the main lookup table LUTa and the three sub-lookup tables LUTc1, LUTc2, and LUTc3 to generate the overdrive pixel data when the temperature of the display 250 is between T1 and T2.

When the temperature of the display 250 changes to a value between T2 and T3, the sub-lookup table LUTc1 is removed from the SRAM 264 and another sub-lookup table LUTc4 is loaded into the SRAM 264. While the sub-lookup table LUTc1 is removed and the sub-lookup table LUTc4 is loaded into the SRAM 264, the timing controller 262 uses the main lookup table LUTa and two sub-lookup tables LUTc2 and LUTc3 to generate the overdrive pixel data.

After the sub-lookup table LUTc4 is loaded into the SRAM 264, the timing controller 262 uses the lookup tables LUTa, LUTc2, LUTc3, and LUTc4 to generate overdrive pixel data when the temperature of the display 250 is between T2 and T3, and so forth.

EXAMPLE 4

In example 4, the timing controller 262 loads a main lookup table LUTa and three sub-lookup tables LUTc1, LUTc2, and LUTc3 into the SRAM 264 upon power on. The difference between example 4 and example 3 is that in example 4, the timing controller uses two of the three sub-lookup tables when the temperature is within a specified range.

For example, when the temperature of the display 250 is between T1 and T2, the timing controller 262 use the main lookup table LUTa and two sub-lookup tables LUTc1 and LUTc2 to generate the overdrive pixel data. When the temperature of the display 250 changes to a value between T2 and T3, the sub-lookup table LUTc1 is removed and another sub-lookup table LUTc4 is loaded into the SRAM 264. While the sub-lookup table LUTc1 is removed and the sub-lookup table LUTc4 is loaded into the SRAM 264, the timing controller 262 uses the main lookup table LUTa and two sub-lookup tables LUTc2 and LUTc3 to generate the overdrive pixel data.

When the temperature of the display 250 changes to a value between T3 and T4, the sub-lookup table LUTc2 is removed and another sub-lookup table LUTc5 is loaded into the SRAM 264. While the sub-lookup table LUTc2 is removed and the sub-lookup table LUTc5 is loaded into the SRAM 264, the timing controller 262 uses the main lookup table LUTa and two sub-lookup tables LUTc3 and LUTc4 to generate the overdrive pixel data, and so forth.

EXAMPLE 5

In example 5, the sub-lookup tables are not modified as the temperature changes. Rather, the offset values of the gray levels at different temperatures are interpolated or extrapolated by multiplying the offset values with coefficients that are functions of the temperature of the display 250. As the temperature changes, the overdrive gray level also changes.

For example, the non-volatile storage 266 stores main lookup tables LUTa, LUTb, LUTc, and LUTd, and sub-lookup tables LUTc1 and LUTc2. Upon power on of the display 250, the timing controller 262 loads the lookup tables LUTa, LUTc1, and LUTc2 into the SRAM 264. The timing controller determines the overdrive gray level OD using the formula $$OD=A+f1(Vt)\times a1+f2(Vt)\times a2,$$

where A is the base value in the lookup table LUTa, a1 and a2 are the offset values in the lookup tables LUTc1 and LUTc2, respectively, and f1 and f2 are functions of the combined thermal sensor signal Vt. The functions f1 and f2 can be the same or different. The function f1 and f2 can be linear function or a polynomial function of Vt, such as $$f1(Vt)=c3\times Vt3+c2\times Vt2+c1\times Vt+c0,$$

where c0 to c3 are constants.

EXAMPLE 6

In example 6, the sub-lookup tables are switched as the temperature changes from one range to another. In addition, the offset values of the gray levels are multiplied by coefficients that are functions of the temperature.

The timing controller 262 loads a main lookup table LUTa and three sub-lookup tables LUTc1, LUTc2, and LUTc3 into the SRAM 264 upon power on. The timing controller 262 uses the main lookup table LUTa and the sub-lookup tables LUTc1 and LUTc2 to generate the overdrive pixel data when the temperature of the display 250 is between T1 and T2 according to the formula:

$$OD=A+f1(Vt)\times a1+f2(Vt)\times a2,$$

where the definitions of OD, a1, a2, f1, f2, and Vt are the same as those in example 5.

When the temperature of the display 250 changes to a value between T2 and T3, the sub-lookup table LUTc1 is removed from the SRAM 264 and another sub-lookup table LUTc4 is loaded into the SRAM 264. The timing controller 262 uses the main lookup table LUTa and two sub-lookup tables LUTc2 and LUTc3 to generate the overdrive pixel data according to the formula:

$$OD=A+f3(Vt)\times a2+f4(Vt)\times a3,$$

where a2 and a3 are the offset values in the lookup tables LUTc2 and LUTc3, respectively. The functions f3 and f4 can be linear or polynomial functions of the combined thermal sensor signal Vt. The functions f3 and f4 can be the same as the functions f1 and f2, respectively.

In example 6, similar to example 4, two of the three sub-lookup tables in the SRAM 264 are used when the temperature remains within a specified range.

Advantages of the display 250 include the following. The display 250 can continuously perform the overdrive function even during the time period for removing and loading the lookup tables in response to temperature changes. The display 250 can show images having a quality that is better than displays that do not use overdrive function when switching lookup tables.

The size of the non-volatile storage 266 for storing the lookup tables can be reduced. Rather than storing several larger-sized main lookup tables for different temperature ranges, one larger-sized main lookup table and several smaller-sized sub-lookup tables can be used. Because the smaller-sized sub-lookup tables are being moved in and out of the SRAM 264, the time required for switching the lookup tables can be reduced (as compared to moving the larger-sized main lookup tables).

Although some examples have been discussed above, other implementations and applications are also within the scope of the following claims. For example, the SRAM 264 can be replaced by other types of memory. The SRAM can be a stand-alone chip or be integrated with the timing controller 262. The EEPROM 266 can be replaced by other types of non-volatile memory. The display panel 260 can be different from a liquid crystal panel. The lookup tables can have different sizes and formats. The timing controller can use different combinations of the lookup tables. The functions f1 to f4 can be different.

The sub-lookup tables can have the same sizes as the main lookup tables so that no interpolation is used when combining the base and offset values in the main and sub-lookup tables. Different data structures can be used for the lookup tables. Two or more lookup tables described above can be combined into one larger lookup table. A main lookup table and one or more sub-lookup table can be combined into one larger lookup table. A lookup table can have two or more portions for use at different temperature ranges. The first portion of the lookup table can be used for a first specified temperature range, and the second portion of the lookup table can be used for a second specified temperature range. Rather than switching the entire lookup table in response to a temperature change, portions of the lookup table can be updated.

The various main lookup tables used for various refresh rates can be replaced by a main lookup table and various sub-lookup tables, the sub-lookup tables storing offset values to be used for various refresh rates. The main lookup tables can correspond to refresh rates different from those described above. The sub-lookup tables can corresponding to temperature ranges different from those described above.

What is claimed is:

1. A method of operating a display, comprising:

deriving first pixel data for overdriving pixel circuits of the display relative to target gray levels based on values in a first lookup table and a second lookup table stored in memory;

rendering the second lookup table unavailable in memory in response to a change in an operating condition of the display;

deriving second pixel data using the first lookup table for overdriving the pixel circuits when the second lookup table is unavailable in the memory;

using the first lookup table and the second lookup table for overdriving the pixel circuits when the temperature of the display is within a first range; and using the first lookup table and a third lookup table for overdriving the pixel circuits when the temperature of the display is within a second range, the first lookup table including base values of overdrive gray levels, the base values representing coarse estimates of the overdrive gray levels, the second lookup table including offset values representing refinements to the coarse estimates for a first temperature range, the third lookup table including offset values representing refinements to the coarse estimates for a second temperature range.

2. The method of claim 1 in which each of at least some of the values in the lookup tables is associated with an initial gray level and a target gray level.

3. The method of claim 1 in which the operating condition comprises a temperature of the display.

4. The method of claim 1 in which deriving first pixel data comprises combining at least one of (a) a first value in the first lookup table and a second value in the second lookup table, (b) a first value in the first lookup table and an interpolated value based on a second value in the second lookup table, and (c) a first interpolated value based on a first value in the first lookup table and a second interpolated value based on a second value in the second lookup table.

5. The method of claim 1 in which deriving first pixel data comprises calculating an overdrive gray level using a coefficient that is a function of a signal representative of the temperature.

6. The method of claim 1, further comprising loading a third lookup table after the second lookup table is rendered unavailable in the memory, and deriving third pixel data using the first lookup table and the third lookup table for overdriving the pixel circuits.

7. The method of claim 1 further comprising applying voltages across a liquid crystal layer of the display, the voltages being based on the first pixel data and the second pixel data.

8. A method comprising:

deriving gray levels for overdriving pixel circuits of a display relative to target gray levels based on values in at least two lookup tables that are stored simultaneously in a memory of the display, different combinations of at least two lookup tables being used to derive the gray levels for different ranges of the temperature of the display;

using a first lookup table and a second lookup table for overdriving the pixel circuits when the temperature of the display is within a first range; and using the first lookup table and a third lookup table for overdriving the pixel circuits when the temperature of the display is within a second range, the first lookup table including base values of overdrive gray levels, the base values representing coarse estimates of the overdrive gray levels, the second lookup table including offset values representing refinements to the coarse estimates for a first temperature range, the third lookup table including offset values representing refinements to the coarse estimates for a second temperature range.

9. The method of claim 8 in which deriving the gray levels comprises deriving each gray level based on a combination of a first value selected from a first one of the at least two lookup tables and a second value selected from a second one of the at least two lookup tables.

10. A method comprising:

selectively loading and removing values into a memory of a display based on an operating condition of the display, each value being useful for deriving a gray level for overdriving a pixel of the display from an initial gray level to a target gray level; and continuously deriving gray levels for overdriving pixels of the display by using the values currently in the memory while other values are being removed from the memory or loaded into the memory;

using a first lookup table and a second lookup table for overdriving the pixels when the temperature of the display is within a first range; and using the first lookup table and a third lookup table for overdriving the pixels when the temperature of the display is within a second range, the first lookup table including base values of overdrive gray levels, the base values representing coarse estimates of the overdrive gray levels, the second lookup table including offset values representing refinements to the coarse estimates for a first temperature range, the third lookup table including offset values representing refinements to the coarse estimates for a second temperature range.

11. The method of claim 10 in which deriving the gray levels comprises deriving each gray level based on a combination of two or more of the values in the memory.

12. The method of claim 10 in which the operating condition comprises a temperature of the display.

13. A display, comprising:

pixel circuits;

a non-volatile storage for storing lookup tables having values useful for deriving overdrive gray levels for overdriving the pixel circuits;

a memory; and a controller for transferring at least two of the lookup tables from the non-volatile storage to the memory and using the lookup tables in the memory to derive overdrive gray levels, the controller using different combinations of two or more lookup tables when a temperature of the display is within different ranges;

wherein the controller uses a first lookup table and a second lookup table to derive the overdrive gray levels when the temperature of the display is within a first range, and uses the first lookup table and a third lookup table to derive the overdrive gray levels when the temperature of the display is within a second range, the first lookup table including base values of overdrive gray levels, the base values representing coarse estimates of the overdrive gray levels, the second lookup table including offset values representing refinements to the coarse estimates for a first temperature range, the third lookup table including offset values representing refinements to the coarse estimates for a second temperature range.

14. The display of claim 13 in which the controller derives overdrive gray levels using at least one lookup table in the memory while rendering another lookup table unavailable in the memory or loading another lookup table into the memory.

15. The display of claim 13 in which the controller derives the overdrive pixel data by using a first value in the first lookup table, a second value in the second lookup table, and a coefficient that is a function of the temperature of the display.

16. The display of claim 15 wherein the function comprises at least one of a linear function and a polynomial function of the temperature.

17. The display of claim 13 in which the first lookup table has values associated with a first number (N1) of initial gray levels and a second number (N2) of target gray levels, the second lookup table has values associated with a third number (N3) of initial gray levels and a fourth number (N4) of target gray levels, and N1×N2 is not equal to N3 ×N4.

18. The display of claim 13, further comprising thermal sensors for sensing temperatures at different locations of the display.

19. The display of claim 13 in which the display comprises a liquid crystal display.

20. An apparatus, comprising:

a controller for determining pixel data for overdriving pixels of a display based on values in two or more lookup tables stored in a memory of the display, the lookup tables storing values each associated with an initial gray level and a target gray level, the overdriving of the pixels intended to induce a faster response of the pixels, the controller using different combinations of two or more lookup tables when the display panel is at different temperatures;

wherein the controller uses a first lookup table and a second lookup table to derive overdrive gray levels when the temperature of the display is within a first range, and uses the first lookup table and a third lookup table to derive the overdrive gray levels when the temperature of the display is within a second range, the first lookup table including base values of overdrive gray levels, the base values representing coarse estimates of the overdrive gray levels, the second lookup table including offset values representing refinements to the coarse estimates for a first temperature range, the third lookup table including offset values representing refinements to the coarse estimates for a second temperature range.

21. A display, comprising:

pixel circuits;

a non-volatile storage for storing lookup tables, the lookup tables storing values each associated with an initial gray level and a target gray level;

a memory having a speed faster than the non-volatile storage;

at least one thermal sensor for sensing a temperature of the display;

a timing controller for deriving overdrive pixel data for overdriving the pixel circuits using values in a combination of two or more of the lookup tables stored in the memory, different combinations of lookup tables being used when the temperature is within different ranges, the timing controller continuously deriving overdrive pixel data using at least one lookup table in the memory while another lookup table is being removed from the memory or loaded into the memory; and data drivers for driving the pixel circuits based on the overdrive pixel data from the timing controller;

wherein the timing controller uses a first lookup table and a second lookup table to derive the overdrive gray levels when the temperature of the display is within a first range, and uses the first lookup table and a third lookup table to derive the overdrive gray levels when the temperature of the display is within a second range, the first lookup table including base values of overdrive gray levels, the base values representing coarse estimates of the overdrive gray levels, the second lookup table including offset values representing refinements to the coarse estimates for a first temperature range, the third lookup table including offset values representing refinements to the coarse estimates for a second temperature range.

* * * * *